United States Patent [19]

Danford

[11] 4,179,857

[45] Dec. 25, 1979

[54] HINGED EAVE ASSEMBLY FOR A STRUCTURE

[75] Inventor: Tiras J. Danford, Quitman, Ga.

[73] Assignee: Harrington Manufacturing Company, Lewiston, N.C.

[21] Appl. No.: 919,169

[22] Filed: Jun. 26, 1978

[51] Int. Cl.[2] ..... E04B 7/16

[52] U.S. Cl. ..... 52/71; 52/69; 52/73; 52/94

[58] Field of Search ..... 16/150, DIG. 13; 52/69, 52/71, 73, 94; 248/48.1, 48.2, 237

[56] References Cited

U.S. PATENT DOCUMENTS

| | | | |
|---|---|---|---|
| 147,329 | 2/1874 | Jones et al. | 248/48.1 |
| 3,783,562 | 1/1974 | Eysenring | 52/94 X |
| 3,998,026 | 12/1976 | Allen | 52/714 |

FOREIGN PATENT DOCUMENTS

| | | | |
|---|---|---|---|
| 543324 | 7/1957 | Canada | 52/714 |

*Primary Examiner*—Alfred C. Perham

*Attorney, Agent, or Firm*—Mills & Coats

[57] ABSTRACT

The present invention relates to a hinged eave assembly for a sectional or modular structure that enables the eave of the structure to be positioned over the roof for transport, thereby reducing the effective width of the structure to conform with State highway laws. Structurally a plurality of elongated metal hinges are utilized to hingedly mount the eave to the roof at certain spaced intervals along the area where the roof joins the upper portion of an underlying wall structure. One end of the metal hinge is split or cut longitudinally so as to form a pair of legs, one leg being bent with respect to the other to form an angle therebetween for receiving the eave. The two legs are secured to the eave while the end of the hinge opposite the legs is secured directly to the roof of the structure. By flexing and bending the metal hinge intermediately between the connection of the roof and eave, allows the eave to be moved between a transport position overlying the roof and an extended position where the eave serves as an overhang.

6 Claims, 4 Drawing Figures

HINGED EAVE ASSEMBLY FOR A STRUCTURE

The present invention relates to static structures and more particularly to an eave-roof assembly for a sectional or modular structure where the eave is movable relative to an adjacent vertical wall to decrease the effective width of the structure for transport along public highways.

BACKGROUND OF THE INVENTION

In recent years, sectional or modular homes have begun to be utilized greater in residential development. The scarcity and cost of labor for custom construction or "stick built" homes have made sectional or modular buildings particularly attractive. Generally, a sectional structure is built in a factory in 2, 3 or more sections and shipped to a site where the sections are arranged and situated on an existing foundation.

It is advantageous and most efficient to build individual sections in relatively large units, because it is most efficient to limit the number of sections used for a particular dwelling design. One principal limiting factor to the section size is State highway laws limiting the width of sections transported over the highways.

It has been known to hingeably mount the eave on a sectional component of a structure in order that during transport the eave may be folded to a transport position overlying the roof. This decreases the effective transport width of the builing module, but still enables the same building module to take advantage of the aesthetic and functional advantages of the eave extension once the structure is placed on a foundation. While hingeably mounted eaves are desirable in connection with the design of module or sectional dwellings, there are a number of disadvantages inherent in a hingeably mounted eave design. In this regard, first, in the prior art, it has been common to utilize thick, heavy duty door type hinges in connecting the eave to the roof of the sectional structure. With such hinges, there is a great deal of labor and time consuming work involved because in order to appropriately connect the hinges between the roof and the eave structure, there is a substantial amount of routing required in order that the hinges may be appropriately countersunk into the roof and eave structure.

One other problem associated with hingeably mounted eaves of the prior art is that the metal hinges utilized experience a great deal of stress as the eave is moved back and forth between transport and the normally extended positions. It is important to provide a hinge construction that will be able to withstand the stress and abuse resulting from supporting the eave structure and the fatigue associated with the bending and flexing of the hinge as the eave is moved between transport and extended positions.

SUMMARY OF THE INVENTION

The present invention provides a hingeably mounted eave-roof assembly for a modular or sectional building structure that is provided with a relatively simple and inexpensive strap type metal hinge design that is capable of withstanding great stress and fatigue and inherently has the strength to carry and support the load of the eave.

In addition, the hinged design utilized in the assembly of the present invention is simple to manufacture and connect between the eave and roof structure without requiring routing or extraordinary labor in fabrication.

It is, therefore, an object of the present invention to provide a hingeably mounted eave-roof assembly that is simple in construction, easy to fabricate and wherein the hinge itself is rugged, durable and has the strength to withstand the load of the eave and fatigue caused by back-and-forth flexing and bending of the hinge as the eave is moved between a transport position overlying the roof and an extended position where the eave serves as an overhang for the structure.

Another object of the present invention is to provide a lightweight metal hinge for a hingeable mounted eave-roof structure assembly wherein the hinge fits neatly between the roof and the eave without requiring routing and wherein the presence of the hinge in no way detracts from the normal aesthetic appearance of the eave about the structure.

A further object of the present invention is to provide a hingeably mounted eave-roof assembly wherein the metal hinges of the character described above are longitudinally spaced at certain intervals between the roof and eave of the structure.

Still a further object of the present invention is to provide a hinge design for an eave-roof assembly that allows the eave to be moved between transport and extended positions as set forth above, wherein the hinge is particularly designed to fasten to the eave about both top and inboard sides of the eave to yield a firm and sturdy connection.

Another object of the present invention is to provide a hinged design for a hingedly mounted eave-roof assembly wherein the hinged design is particularly designed to connect to structural components of the structure having substantial strength and integrity such as rafters of the roof, the studs of the side walls of the structure, and the cross members of the eave.

A further object of the present invention is to provide a strap hinge for hingeably connecting an eave to a roof structure where the strap hinge provides positive location of the eave in relationship to the roof in an extended position.

It is also an object of the present invention to provide a strap hinge of the character described above that eliminates the undesirable bend or bends that are associated with a single strap hinge of the type found in the prior art.

Another object of the present invention resides in the provision of a strap hinge design that permits the use of a relatively heavy gauge material, but yet which will function satisfactory.

It is also an object of the present invention to provide a strap type hinge for hingeably mounting an eave to a roof structure that substantially reduces the labor required in aligning the eave with the roof after the eave has been rotated to the extended position once the house is placed on site.

Finally it is an object of the present invention to provide a hingeably mounted eave structure that includes a substantial overhang of approximately twenty-four inches or more, and wherein a strap type hinge, forming a part of said hingeably mounted eave structure, is provided to properly support live and dead loads to meet certain building codes.

Other objects and advantages of the present invention will become apparent from a study of the following description and the accompanying drawings which are merely illustrative of the present invention.

DESCRIPTION OF PREFERRED EMBODIMENT

Figure 2:
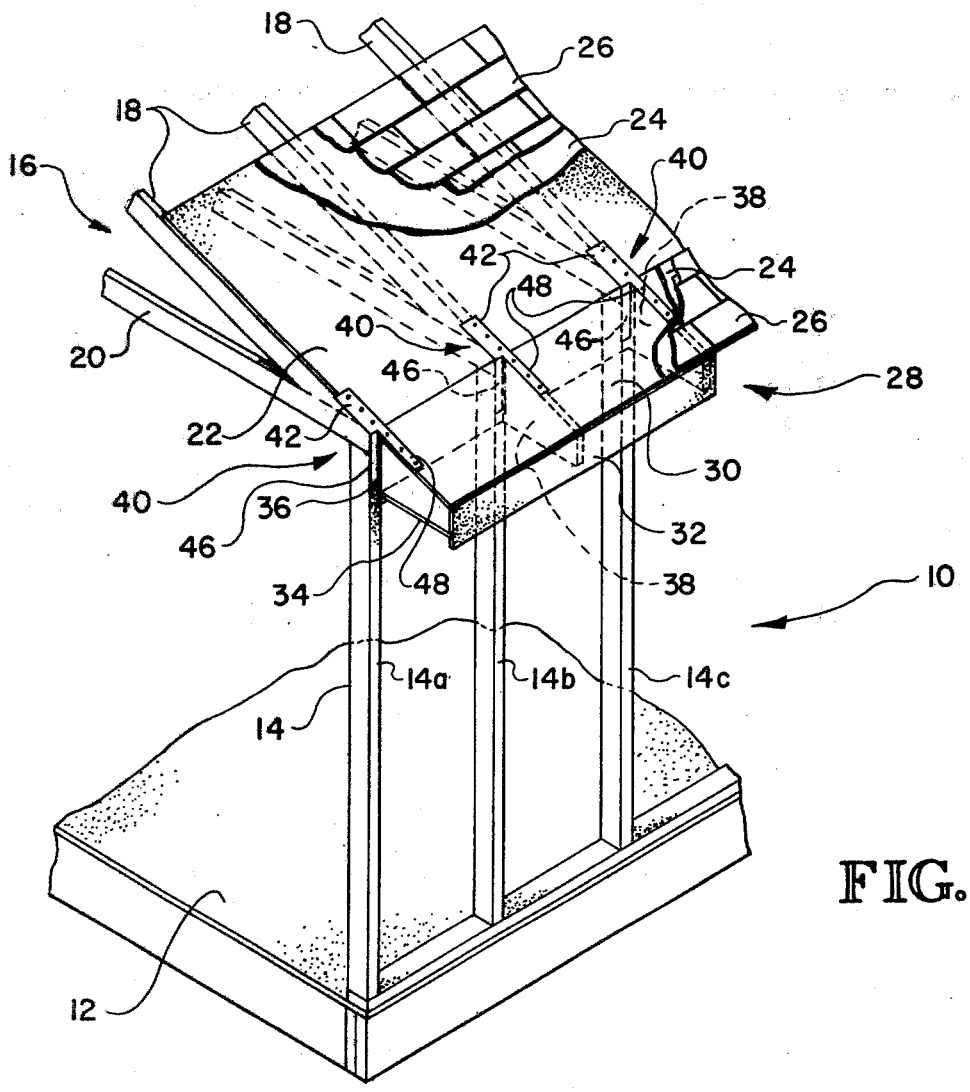
FIG. 2 is a fragmentary perspective view of a modular or sectional building unit with an eave hingeably mounted to the roof in accordance with the present invention.

With further reference to the drawings, particularly FIG. 2, a modular or sectional building unit is shown therein and indicated generally by the numeral 10. Briefly reviewing the modular or sectional building unit 10 the same comprises a floor section 12, and a vertical wall section 14 extending upwardly therefrom, the wall section including a plurality of longitudinal studs 14*a*, 14*b*, and 14*c*. Extending about the top of the sectional building unit 10 is a roof structure indicated generally by the numeral 16. Roof structure 16 includes a plurality of longitudinally spaced roof trusses in which each truss includes a rafter 18 and a ceiling joist 20. The roof 16 further includes a plywood sheathing 22 fastened to the top of the rafters 18, a felt covering 34 disposed above the plywood sheathing 22, and shingles 26 secured to the felt covering 24.

Disposed about the lower terminal edge of the roof 16 is an eave structure, indicated generally by the numeral 28, that in accordance with the present invention is hingeably mounted to the lower side terminal edge of the roof 16 to provide an overhang for the structure. Viewing the eave 28 in more detail, the same is comprised of a top 30 that basically corresponds to the structure of the roof 16 in that the same would conventionally include a plywood sheathing, a felt covering disposed over the plywood sheathing and shingles secured to the felt covering. Continuing to refer to the eave 28, it is seen that the same includes an outboard side 32 that is comprised of a facia which is typically a 1×6 board member. Eave 28 also includes an inboard side 36 that includes an upper contact 36*a*, which is typically a 1×4 and a lower nailer contact 36*b* which is typically a 1×6. Rigidity is imported to the eave 28 by the provision of a series of longitudinally spaced cross members 38 that extend between the inboard side 36 and the outboard side 32 of the eave 28, with the cross members being normally spaced apart a distance corresponding to the spacing between the roof trusses which could preferably be two feet. It is appreciated that the eave 28 is preferably disposed adjacent the roof 16 such that the cross members 38 of the eave are generally aligned with the roof truss components, namely, the rafters 18 and the ceiling joist 20.

The present invention relates to a hingeably mounted eave-roof assembly for a sectional structure 10 of the type shown in FIG. 2. To provide for the hinge mounting of the eave 28, the present invention provides a series of longitudinally spaced metal hinges, each indicated generally by the numeral 40, interconnected between the roof 16 and the eave 28.

Figure 1:
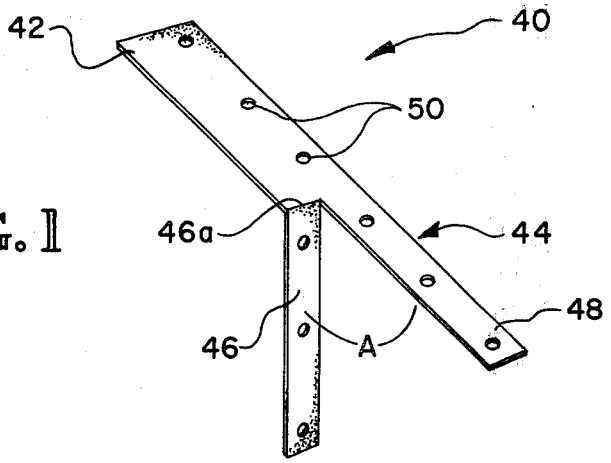
FIG. 1 is a perspective view of the metal hinge utilized in the hingeably mounted eave-roof assembly of the present invention.

Viewing the hinge construction, as particularly shown in FIG. 1, the same is basically comprised of an elongated metal strip, such as a piece of 16 gauge sheet metal. In the preferred embodiment shown herein, it is contemplated that the hinge before cutting and fabrication would be approximately 2½ inches wide and 16 inches long. It will be understood, however, that the side could vary depending on the particular application and the load to be carried.

Viewing the metal hinge 40, in detail, it is seen that the same is of a strap type hinge design including one end 42 that is referred to as a roof fastening end. The other end is referred to by the numeral 44 and includes a longitudinal split from an intermediate point outwardly to the end of the hinge defining a pair of legs 46 and 48. One leg, referred to by the numeral 46 in FIG. 1, is bent about a seam 46*a* with respect to leg 48 to define an angle A therebetween that is also referred to as an eave receiving angle.

To properly interconnected the hinge 40 between the roof 16 and eave 28, the hinges 40 are secured to the eave with the upper leg 48 being secured to the top of the eave 30 preferably at intervals corresponding to the spacing of the cross members 38. The use of 8*d* nails through nail openings 50 provided within each hinge 40 enables the upper leg 48 to be secured directly to the top of the eave 28 and particularly nailed to the plywood sheathing thereof and downwardly into an underlying cross member 38.

The hinge 40 is positioned about the eave 28 such that the upper inside corner of the eave 28 fits flush into the apex of angle A formed by the two legs 46 and 48.

The lower leg 46 is nailed to the inboard side 36 of the eave 28. Therefore, it is appreciated that the eave 28 is secured to the hinge 40 by connecting both legs 46 and 48 to the inboard side and top of the eave respectively.

Hinge 40 is connected to the roof 16 by directly nailing the roof fastening end 42 to the plywood sheathing 22 of the roof at selected longitudinal spacings along the roof, as illustrated in FIG. 2. It is important to realize that the hinge 40 is placed directly adjacent the top of the plywood sheathing 22 and fasten thereto without any routing or countersinking of the hinge within the roof.

Figure 4:
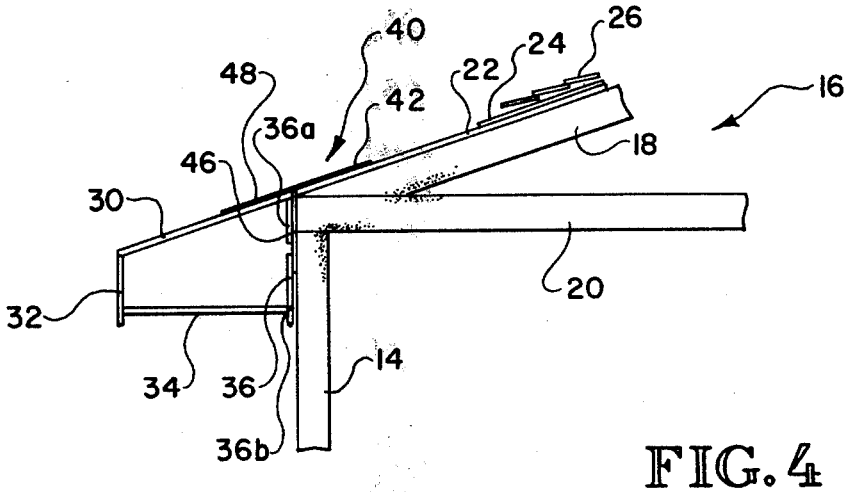
FIG. 4 is a fragmentary sectional view similar to FIG. 3 with the hingeably mounted eave being rotated or positioned in a functional extended position to serve as an overhang for the structure.

In fabricating the hinged eave-roof assembly of the present invention, approximately three courses of shingles are left off of the roof and eave at the time of fabrication in the plant, and not placed about the roof and eave structure until the particular structural sectional is placed on its foundation at the building site and the eave has been rotated down to its normal functional extended position shown in FIG. 4.

Figure 3:
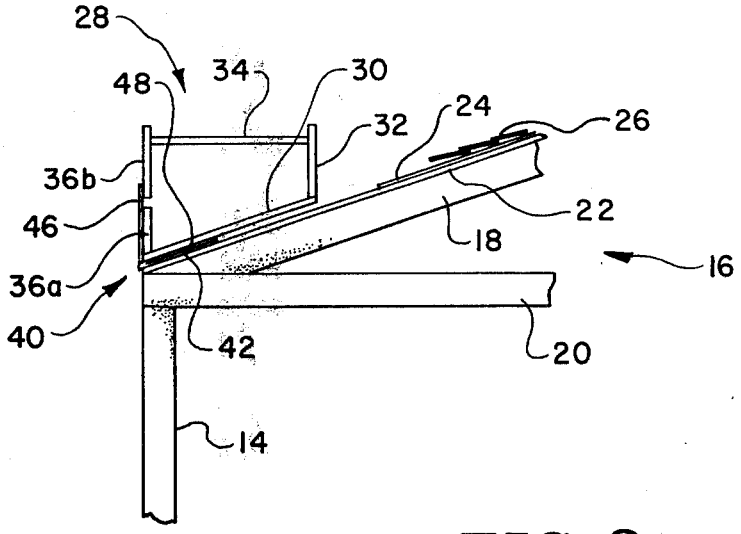
FIG. 3 is a fragmentary sectional view of a building unit section having the hingeably mounted eave of the present invention incorporated therein with the eave being rotated to a transport position where the same overlies the roof.

From the foregoing specification, it is seen that in transporting the modular building section 10, as shown in FIG. 2, from the fabrication facilitity to the construction site, the eave 28 is rotated and moved to a transport position where the eave 28 overlies the roof as illustrated in FIG. 3. During transport, the eave could be temporarily anchored in this transport position by straps, connectors or the like by connecting the eave 28 as positioned in FIG. 2 with the rafters 18 or some other convenient component of the structure. After the modular building unit is received on the construction site and appropriately positioned on its existing foundation, the temporary anchor connections or straps can be detached and the entire eave 28 rotated, counterclockwise as viewed in FIG. 3, to a stationary extended position, as shown in FIG. 4, where the eave serves as a functional overhanging for the structure. After this has been done, the eave 28 can be permanently anchored to the wall structure 14 by nailing the eave to the wall structure 14 and/or any of the particular studs 14*a*, 14*b*, 14*c* of the wall structure. It is appreciated that in moving the eave 28 between the transport position, FIG. 3, and the extended position, FIG. 4, that the hinge 40 flexes and bends intermediately between its connection to the roof and its connection to the eave. The particular design of the hinge 40, allows this flexing and bending to occur time after time without rupturing or breaking due to stress and fatigue.

The terms "upper", "lower", "forward", "rearward", etc., have been used herein merely for the convenience of the foregoing specification and in the appended claims to describe the hinged eave assembly for a structure and its parts as oriented in the drawings. It is to be understood, however, that these terms are in no way limiting to the invention since the hinged eave assembly for a structure may obviously be disposed in many different positions when in actual use.

The present invention, of course, may be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced herein.

What is claimed is:

1. In a hinged eave-roof assembly of a structure of the type where the eave comprises a top, an inboard side and an outboard side and is movable between a transport position overlying the roof to a normal functional extended position where the eave appears to be a normal extension of the roof, the improvement comprising: a metal hinge for hingedly connecting said eave to the roof structure with the metal hinge being split longitudinally about one end thereof so as to divide one end of said hinge into two distinct sections, and wherein one of the split sections is bent so as to form an angle of less than 180 degrees with the other split section, and wherein opposite said split sections a roof attaching portion is defined and fastened to said roof while the bent split section lies adjacent to and is fastened to the inboard side of said eave and the other split section lies adjacent to and is fastened to the top of said eave, whereby said eave can be moved back and forth between said transport and extended positions by the bending and flexing of the metal hinge above an area between the roof attaching position and the split sections and wherein the eave is securedly held within the hinge by the two split sections and securedly held adjacent the roof structure by the interconnection formed by the hinge extending between said roof and eave.

2. The improved hinged eave-roof assembly of claim 1 wherein said metal hinge has a width of at least one inch, and wherein each split section has a width of at least one-half inch.

3. The improved hinged eave-roof assembly of claim 1 wherein said roof is supported in part at least by a wall structure comprised of a series of vertically extending, spaced apart studs, and wherein said eave includes a plurality of longitudinally spaced transversely extending cross members, and wherein said eave is so spaced relative to said wall structure such that the one split section fastened to the inboard side of said eave aligns with respective studs of said wall structure, while the other split section of said hinge aligns with a respective cross member of said eave.

4. The improved hinged eave-roof assembly of claim 3 wherein said hinge is constructed of 18 gauge sheet metal.

5. The improved hinged eave-roof assembly of claim 4 wherein said improved hinged eave-roof assembly comprises a plurality of said hinges interconnected between said roof and said eave, with respective hinges being spaced at least 2 feet apart.

6. A hinged eave-roof assembly for a modular or sectional structure that enables the eave to be moved between a transport position overlying the roof to a normally extended position to form an overhang from said roof, said assembly comprising: a roof having a terminal edge that lies adjacent an upstanding wall of said structure; an eave hingedly mounted along the terminal edge of said roof for movement between said transport position and said extended position, said eave including an inboard side, a top, and an outboard side; a plurality of spaced apart metal hinges interconnecting said roof and eave, such that said eave may be moved between said transport and extended positions by bending and flexing said metal hinge, each metal hinge comprising an elongated metal strip having a longitudinal split formed about one end thereof with said longitudinal split dividing said metal strip of said hinge into first and second legs, and wherein said first leg is bent relative to said second leg to form an eave receiving angle therebetween so as to allow the eave to be held and supported between the defined angle of said two legs; fastening means for attaching the end of said metal hinge opposite said first and second legs to said roof; second fastening means for attaching said first leg directly to the inboard side of said eave; and third fastening means for attaching said second leg directly to the top of said eave.

* * * * *